US006450241B1

(12) United States Patent
Lehman

(10) Patent No.: US 6,450,241 B1
(45) Date of Patent: Sep. 17, 2002

(54) METHOD FOR CONTINUOUS CASTING AND DEVICE FOR CARRYING OUT THE METHOD

(75) Inventor: Anders Lehman, Bromma (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/623,255

(22) PCT Filed: Feb. 18, 1999

(86) PCT No.: PCT/SE99/00222

§ 371 (c)(1),
(2), (4) Date: Aug. 31, 2000

(87) PCT Pub. No.: WO99/44770

PCT Pub. Date: Sep. 10, 1999

(30) Foreign Application Priority Data

Mar. 2, 1998 (SE) ..... 9800637

(51) Int. Cl.[7] ..... B22D 27/02
(52) U.S. Cl. ..... 164/468; 164/466; 164/504
(58) Field of Search ..... 164/466, 468, 164/502, 504

(56) References Cited

U.S. PATENT DOCUMENTS 4,873,605 A * 10/1989 Drits et al. ..... 361/143
5,722,480 A * 3/1998 Asai et al. ..... 164/466

FOREIGN PATENT DOCUMENTS

| | | |
|---|---|---|
| EP | 0 279 101 A3 | 8/1988 |
| EP | 0 729 798 A1 | 9/1996 |
| WO | WO 9717151 A1 | 5/1997 |

* cited by examiner

*Primary Examiner*—M. Alexandra Elve
*Assistant Examiner*—Len Tran
(74) *Attorney, Agent, or Firm*—Dykema Gossett PLLC

(57) ABSTRACT

A method and a device for continuous or semi-continuous casting of metal, where hot melt is supplied to a cooled continuous casting mold and the melt is cooled and formed to a at least partly solidified strand as it passes through the mold. An inductive coil is arranged at the top end of the mold to, when supplied with an alternating electric high frequency current, generate a high frequency magnetic field to act upon the melt in the mold, whereby heat is developed in the melt and compressive forces acting to separate the melt from the mold wall are generated. The coil is supplied with the high frequency current from a power supply unit with a current control to supply an alternating electric high frequency current having a base frequency of 50 Hz or more to the inductive coil. The current control has modulation means for modulating and controlling the supplied current is controlled in a pulsed, amplitude modulated manner with an amplitude modulated modulation frequency of 10 Hz. or less, whereby essentially full amplitude of the amplitude modulated current is achieved within a rise time corresponding to 1 cycle of the base frequency or less at the start of a pulse.

22 Claims, 6 Drawing Sheets

METHOD FOR CONTINUOUS CASTING AND DEVICE FOR CARRYING OUT THE METHOD

TECHNICAL FIELD

The present invention relates to a method for continuous or semi-continuous casting of metal or metal alloys into an elongated strand. The strand is cast using a device comprising a cooled continuous casting mold and an inductive coil arranged at the top end of the mold. The coil being supplied with a high frequency alternating current from a power supply. The invented method ensures that temperature and other casting conditions determining the initial solidification conditions in the mold are controlled such that a cast product, a strand, exhibiting an improved surface characteristics, a controlled cast structure, a low level of entrapped inclusions and other defects is produced at maintained or increased productivity. The present invention also relates to a device including the continuous casting mold, the coil, a power supply unit with control means suitable for the invented method.

BACKGROUND ART

During continuous or semi-continuous casting of metals and metal alloys, a hot metal melt is supplied to a cooled continuous casting mold, i.e. a mold which is open in both ends in the casting direction. The mold is preferably water-cooled and typically surrounded and supported by a structure of support beams. Melt is supplied to the mold where the metal is solidified and a cast strand is formed as it is passed through the mold. A cast strand leaving the mold, comprises a solidified, self-supporting surface layer or shell around a residual melt. Generally it can be said that conditions of initial solidification is critical for both quality and productivity. The conditions of initial solidification is dependent on a number of factors influencing each other in a complex manner, such as;

Metal flow in the upper part of the mold;

Lubrication between the mold and the melt/cast strand;

Heat losses and overall thermal conditions at the meniscus;

Thermal conditions and heat dissipation at the front of solidification; and

Oscillation, if any, of the mold.

A lubricant is typically supplied to the upper surface of the melt in the mold. The lubricant serves many purposes, amongst others it will prevent the skin of the cast strand first developed from sticking to the mold wall. Should the solidified skin stick or adhere more severely to the mold it will show as surface defects and in some cases as ripping of the first solidified skin. For large dimension strands of steel the lubricant is predominantly a so-called mold powder comprising glass or glass forming compounds that is melted by the heat at the meniscus. The mold powder is often continuously added to the upper surface of the melt in the mold during casting, as an essentially solid, free flowing particulate powder. The composition of a mold powder is customized. Thereby the powder will melt at a desired rate and lubrication will be provided at the desired rate to ensure lubrication. A too thick layer of lubricant between mold and cast strand will also affect the solidification conditions and surface quality in an undesired way, thus the thermal conditions at the meniscus need to be controlled. For smaller strands and for non-ferrous metals oil, typically vegetable oil, or grease is used as lubricant. Irrespective of what type of mold lubricant is used it should preferably be fed into the interface cast strand/mold at an even rate sufficient to form a thin uniform film in the interface to avoid surface defects originating from adherence between mold and strand. A too thick film might cause uneven surface and disturbs the thermal situation.

Heat losses and overall thermal conditions at the meniscus are predominantly controlled by the secondary flow that is developed in the mold. The use of inductive HF heaters for influencing the thermal situation at the top end is discussed in e.g. U.S. Pat. No. 5,375,648 and in earlier not yet published Swedish Patent Application No. SE9703892-1. High thermal losses are compensated by a supply of heat to the upper surface, either by a controlled upward flow of hot melt or by a heater, otherwise the meniscus can start to solidify. Such a solidification will severely disturb the casting process and destroy the quality of the cast product in most aspects.

A high frequency inductive heater arranged at the top end of a continuous casting mold will provide means to improve the capability to control the temperature of the metal at the upper surface of the melt, the meniscus, and the same time generate compressive forces acting to separate the melt and the mold, thereby reducing the risk for sticking, reducing oscillation marks and in general provide improved conditions for mold lubrication. The improved lubrication is primarily attributed to the compressive forces acting to separate the melt from the mold. The inductive heater may be of single-phase or poly-phase design. Preferably a high-frequency magnetic alternating field is applied. The compressive forces, generated by the high frequency magnetic field, reduce the pressure between the mold wall and the melt, whereby the conditions for lubrication are significantly improved. Surface quality of the cast strand is improved and the casting speed can be increased without risking the surface quality. Oscillation is preferably applied to ensure that the cast strand leaves the mold. However minor surface defects, so-called oscillation marks are normally formed on the cast strand upon contacts between mold and strand during the formation of the skin. These oscillation marks also effect the structure of the cast strand as inclusions often are trapped at them. As the compressive forces act to separate the melt from the mold they will minimize any contact between the melt and mold during initial solidification of the skin and improve the feed of lubricant thereby further improving the surface quality of the cast strand. Thus the use of multi-turn coil supplied with a high frequency alternating current and arranged at the meniscus is believed to provide a means to eliminate or at least substantially reduce the oscillation marks and thereby improving surface quality, internal structure, cleanliness and also productivity.

SUMMARY OF THE INVENTION

It is an object of the invention to provide a method for continuous casting of metal strand, wherein the conditions for the initial solidification of the cast metal in the mold are improved and in particular the conditions for mold lubrication is improved. In particular it is an object of the present invention to control the high frequency magnetic field, which is applied to act on the melt at the top end of the mold, such that the generated compressive forces acting to separate the melt from the mold ensuring a stable feed of mold lubricant into the interface between the mold and the strand and a formation of a lubricating film in the interface. Thereby can surface defects such as internal oscillation marks and any defects or productivity concern associated with them be essentially eliminated or at least substantially reduced. This is accomplished by the present invention, which according to one aspect provides a method for continuous or semi-continuous casting of metal according to the preamble of claim 1, which is characterized by the features of the characterizing part of claim 1. Further developments of the method are characterized by the features of additional claims 2 to 13.

It is further an object of the present invention to provide a continuous casting device comprising a cooled continuous casting mold, oscillation means, a multi-turn inductive coil supplied with a high frequency alternating current and a power supply unit with current control means to generate and control the high frequency magnetic field applied to act on the melt at the top end of the mold.

In particular the casting device shall comprise means to control the alternating current supplied to the high frequency magnetic field generating device such that casting conditions and operating parameters are optimized to accomplish quality improvements and/or productivity improvements. In particular shall the casting device be arranged with means such that forces acting on the melt and movements or flows in the melt are controlled such that the oscillation marks can be essentially eliminated or at least substantially reduced. It is further an object to provide a continuous casting device that ensures good and controlled thermal, flow, lubrication and overall conditions at the top end of the mold, thus attaining considerable improvements with respect to quality and productivity. This is achieved with a device for continuous casting of metals according to another aspect of the present invention, that provides a device for continuous or semi-continuous casting of metal according to the preamble of claim 14, which is characterized by the features of the characterizing part of claim 14. Further developments of the device are characterized by the features of additional claims 15 to 22.

The elimination or substantial reduction of oscillation marks further improves the cast structure and removal of inclusions as inclusions and/or defects are trapped at the oscillation marks.

DESCRIPTION OF THE INVENTION

A method for continuous or semi-continuous casting of metal wherein, hot melt is supplied to a cooled continuous casting mold, the melt is cooled and formed to a at least partly solidified strand as it passes through the mold, and a high frequency magnetic field having a base frequency of from 50 Hz or more is applied to act on the melt at the top end of the mold using an inductive coil such that heat is developed in the melt and compressive forces acting to separate the melt from the mold wall are generated, whereby a current is supplied from a power supply to the coil for generation of the magnetic high frequency field, is according to the present invention carried out in a manner wherein the supplied current is controlled in a pulsed, amplitude modulated manner with an amplitude modulated modulation frequency of 10 Hz or less, whereby essentially full amplitude of the amplitude modulated current is achieved within a rise time corresponding to 1 cycle of the base frequency or less at the start of a pulse. This minimized rise time of the current amplitude at the start of each pulse cycle to full amplitude is essential to achieve the desired control of the compressive forces acting to reduce to the pressure between the mold wall and the melt at the top end of the mold. Hereby the conditions for lubrication are significantly improved and further they can be controlled by the amplitude modulated current supply. This offers a capability for improvements of surface quality of the cast strand and also for an increased casting speed without risking the surface quality. Preferably the rise time is minimized such that essentially full amplitude of the amplitude modulated current is achieved within a rise time corresponding to ¼ (0.25) cycle of the base frequency or less at the start of a pulse.

It is when carrying out the method according the present invention preferred to supply a high frequency current with a base frequency of from 50 to 1000 Hz and to control this current supplied from the power supply to the inductive coil in a pulsed, amplitude modulated manner with an amplitude modulated modulation frequency of from 0.1 to 10 Hz. Preferably a high frequency current with a base frequency of about 200 Hz is supplied. The duty cycle of the high frequency current can be varied from 0 to 100% of the modulation frequency period.

According to one preferred embodiment the pulsed current is supplied in an essentially rectangular manner wherein the output current is varied between two levels. The output current can then be supplied in an on-off manner, wherein in the output current in the off-periods is an essentially zero output current. Alternatively the pulsed current is supplied in an essentially rectangular manner between two current amplitude levels, wherein the output current at both levels is separated from zero.

According to one further embodiment also the time-period for fall of the current amplitude at the end of a pulse is minimized to a time corresponding to 1 cycle of the base frequency of the high frequency current or less, preferably to a time corresponding to ¼ (0.25) cycle of the base frequency of the high frequency current or less.

Typically the mold is oscillated during casting and when the method according to the present invention is carried out in such an oscillated mold it is often favorable to adopt a preferred embodiment of the present method in which the pulsed modulation frequency of the amplitude modulated current is associated with the frequency of the mold oscillation, such that the variations in the compressive forces are coordinated with the mold oscillation.

The current is then according to a preferred manner pulsed with a modulation frequency in the same order as the oscillation frequency but the pulsed frequency and the oscillation frequency can also be associated in any suitable manner which generates a control of the compressive forces acting to reduce to the pressure between the mold wall and the melt at the top end of the mold.

A suitable device for carrying out a method for continuous or semi-continuous casting of metal according to the present invention comprises, a cooled continuous casting mold, means for supplying hot melt to the mold, means for extracting and/or receiving a cast strand formed in the mold from the mold, an inductive coil arranged at the top end of the mold to, when supplied with an alternating electric high frequency current, generate a high frequency magnetic field to act upon the melt in the mold, whereby heat is developed in the melt and compressive forces acting to separate the melt from the mold wall are generated, and a power supply unit with current control means to supply an alternating electric high frequency current having a base frequency of 50 Hz or more to the inductive coil, wherein the current control means according to the present invention further comprises modulation means for modulation and control of the supplied current in a pulsed, amplitude modulated manner with a modulation frequency of 10 Hz or less, whereby essentially full amplitude of the amplitude modulated current is achieved within a rise time at the start of a pulse corresponding to 1 cycle of the base frequency or less.

The current control means comprises means, which dependent on the continuous casting machines and casting variables modulation is adapted;

for on-off modulation of the load coil current supplied to the coil;

for modulation between any two current levels of the load coil current supplied to the coil;

for modulation of waveform envelope shapes having any periodic waveform pattern such as sine, triangular, or trapezoidal modulation envelopes of the load coil current supplied to the coil; or for a programmable arbitrary modulation waveform pattern generation of the load coil current supplied to the coil.

According to one embodiment the current control means comprises a converter with a series resonant circuit with modulation means for supplying a current with an amplitude modulation pattern exhibiting an essentially rectangular wave configuration. Preferably the modulation means arranged for supplying a current with an amplitude modulation pattern exhibiting an essentially rectangular wave configuration with off periods alternating with on periods in a supply frequency, wherein the off and on periods comprise a plurality of cycles of the base frequency of the amplitude modulated current supplied to the inductive coil.

The series resonant circuit used in one preferred embodiment typically comprises a quench thyristor in parallel with a DC smoothing reactor, that the thyristor, in the on-off rectangular modulation mode is adopted to;

control the voltage to which the series resonant capacitor is charged at the end of each on modulation period to an optimal level, and trap the energy stored in the smoothing reactor during the off period with in each modulation cycle, thereby a release enabling of the energy into an inverter circuit at the beginning of the next on modulation period. These two functions being critical to the attainment of a nearly perfectly rectangular leading edge modulation envelope shape of the output current of the converter, which in turn is necessary for optimal surface and metallographic microstructure of the continuously cast end product.

According to one alternative embodiment the modulation means are arranged for supplying a current with a modulation pattern exhibiting an essentially rectangular wave configuration varying between two levels, that the current amplitude is held essentially constant at these two levels for time periods comprising a plurality of complete cycles of the base frequency of the amplitude modulated current supplied to the inductive coil.

BRIEF DESCRIPTION OF THE DRAWINGS

In the following the invention will be explained in greater detail and be exemplified by means of preferred embodiment with reference to the accompanying figures.

DESCRIPTION OF THE PREFERRED EMBODIMENTS

Figure 1:
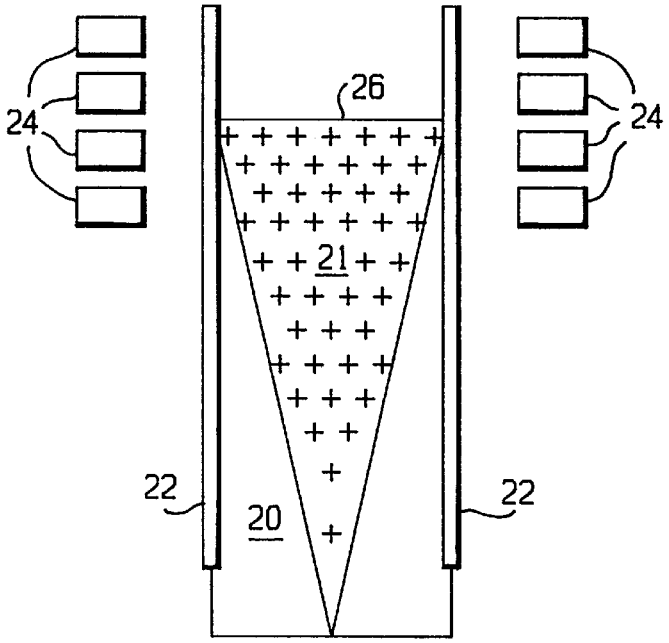
FIG. 1 shows a cut along the casting direction through the top end of a mold for continuous casting of metal with a electromagnetic field generating device arranged at the top end of the mold.

The device for continuous casting of metal shown in the FIG. 1 comprises a continuous casting mold 22. A continuous casting mold is open in both ends in the casting direction and is arranged with cooling means, preferably the mold comprises a system of internal cavities or channels wherein a coolant flows during operation, and means for ensuring that the formed cast strand 20 continuously leaves the mold. The cooled mold 20 is continuously supplied with a primary flow of hot melt, the hot metal 21 is cooled and a cast strand 20 is formed in the mold 22. The mold 22 is usually a water-cooled copper mold. The mold 22 and any support beam comprises internal cavities or channels, not shown, in which the water, flows during casting. During casting a primary flow of hot melt is supplied to the mold 22. As the metal passes through the mold 22 it is cooled and solidified whereby a cast strand 20 is formed. When the cast strand 20 leaves the mold 22, it comprises a solidified, self-supporting surface shell around a remaining residual melt 21. Generally it can be said that the surface conditions and of course the cast structure is highly dependent on the conditions of initial solidification. But also metal cleanliness will depend on the conditions in the top end of the mold, i.e. the locations at which the metal starts to solidify and the conditions at the interface mold/strand and at the meniscus. To control the thermal situation at the top end of the mold 22 and the lubricating conditions is a device for generation of a high frequency magnetic field e.g. an inductive coil 24, 25 arranged at this top end at level with the top surface of the melt in the mold, the meniscus 26. The coil 24 as shown in FIG. 1 is arranged outside the mold 22 and the high frequency magnetic field alternating generated by the coil 24 has to penetrate the mold 22 and into the melt. The inductive coil 24 may be a single-phase or a poly-phase coil. When the high frequency magnetic field is applied to act on the melt 21, heat is developed in the melt so that the temperature of the melt adjacent to the meniscus 26 can be controlled. At the same time compressive forces acting on the melt are developed by the high frequency alternating field. The compressive forces reduce the pressure between the mold 22 and the melt 21 and thus improve the condition for lubrication significantly. Improvements obtained when casting according to the present invention relates to many quality and productivity aspects such as;

Heat efficiency;

More mechanically stable mold;

Cleanliness;

Surface quality;

Controlled cast structure;

Reduced down-time; and

Provisions to increase casting speed and /or reduce oscillation.

According to a preferred embodiment of the invention, a converter incorporating a series resonant load circuit is provided for generating an alternating current which can be amplitude or pulse modulated in such a manner as to obtain rise times to full amplitude on the order of ¼ cycle of the natural resonant frequency of the series resonant load circuit used in the device according to the present invention and to facilitate the method according to the present invention.

Figure 2:
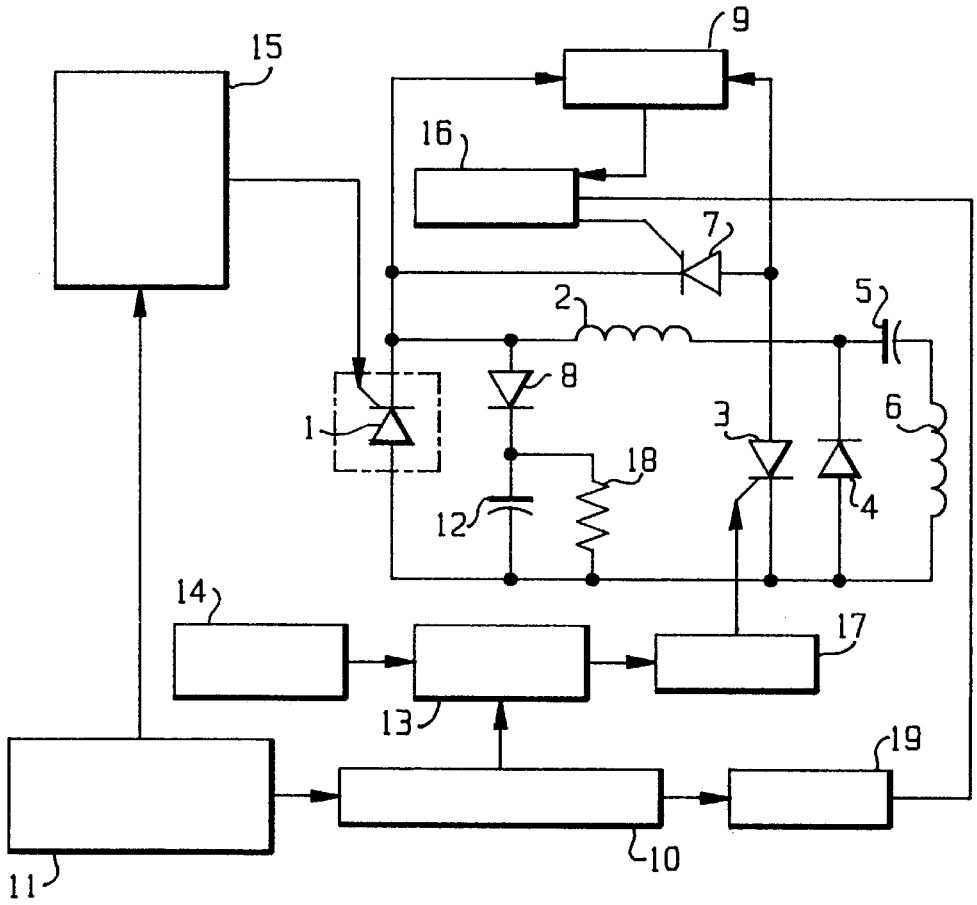
FIG. 2 shows a series resonant circuit comprised in a power supply unit used for controlling the current supply to the multi-turn coil in accordance with an embodiment of the present invention.

Referring to FIG. 2, a schematic diagram of the specially configured series resonant converter used according to the present invention is presented. Referring to the elements shown on this diagram, the operating principles will be described. The electrical utility power source, typically a three phase alternating voltage ( AC- voltage) of suitable power rating is connected to rectifier 1. The rectifier converts the AC into a proportional direct voltage (DC voltage). The DC voltage is applied through a smoothing reactor to the anode of the inverter thyristor 3. Although a thyristor is shown, any suitable switching device, such as a transistor, IGBT, IGCT, etc. may be used. A diode 4 is connected in antiparallel with the thyristor. A series connected resonant load circuit consisting of capacitor 5 and induction coil 6 is connected across the inverter thyristor 3. One special feature of the inverter is the quench thyristor 7 which is connected in parallel with smoothing reactor 2.

The operation of the series resonant converter will now be described. Upon application of utility voltage to the input terminals of rectifier 1, a proportional DC voltage is developed at the output terminals of the rectifier. The series resonant capacitor 5 is initially in a discharged state. A current consequently flows through the smoothing reactor 2 following a sinusoidal contour until capacitor 5 is fully charged. The energy stored in reactor 2 will be discharged into capacitor 5, following the relation $$\frac{1}{2}*L*I^2=\frac{1}{2}*C*V^2$$

This results in a stored voltage level across capacitor 5 which is approximately twice the nominal DC voltage at the output terminals of rectifier 1. This voltage will be drained down to the nominal rectifier DC voltage level through snubber diode 8 into resistor 18, the value of which determines the discharge time constant.

Essentially, two modes of operation are provided. In the on-off pulse modulation mode, a variable duty cycle pulse control signal generator 10 is enabled. The output signal has independently variable cycle time and repetition rate. The repetition rate can also be governed by external trigger input 11 which is linked to the continuous caster mold longitudinal oscillation mechanism. This link allows any desired synchronization of the mold movement and the modulation of the output current of the converter, for purposes of process optimization as previously described.

The output signal from the modulation pulse generator is applied to a firing pulse generator 17, which generates appropriate signals as are required for reliable firing of the inverter thyristor.

As the firing pulse is applied across the gate of the thyristor, it begins to conduct and current flows from rectifier 1 through reactor 2 into thyristor 3. The DC current linearly increases through reactor 2 at a rate which is governed by its inductance. At the same time, series resonant capacitor 5 is discharging through inductor 6 into thyristor 3 resonantly producing a resonant half sine current contour through the thyristor. The current rises sinusoidally to a peak value determined by the impedance of induction coil 6 and the initial charge voltage across capacitor 5. The current then rings resonantly downward toward zero. Shortly after the current through thyristor 3 passes through zero, the thyristor commutates to a non-conducting state. However, the current continues to rings resonantly in the negative direction by means of conduction through antiparallel diode 4. During the time of the conduction of diode 4, the DC current through reactor 2 continues to rise and is actually subtracting from the current through diode 4. The resonant current through diode 4 then rings resonantly back toward the zero crossing point. Shortly after passing through zero, the diode 4 commutates to the off state. At this point, the energy which has built up in reactor 2 is discharged into series resonant capacitor 5, the voltage across which begins to rise. during this process, when the voltage across reactor 2 rises to a level corresponding to the setting of voltage threshold detector 9, a firing pulse is delivered to quench thyristor 7 which effectively short circuits the terminals of reactor 2, preventing the voltage across it from rising any further than the preset level. A alternative mechanism for triggering the quench thyristor 7 is variable delay generator 19 which can produce a firing pulse via firing pulse generator 16 at controlled delay time from the trailing edge of the variable duty cycle on-off modulating pulse generator 10. Either variable delay means 11 or voltage comparator means 9, or a combination of both can be used for the purposes of appropriately controlling the firing point of quench thyristor 7.

Quench thyristor 7 limits the voltage across series resonant capacitor 5 to a predetermined optimal level to insure that the next rising modulation envelope edge has the squarest possible modulation envelope of the current waveform. At the same time, it traps the energy stored in the reactor, for a maximum time period corresponding to the (L/R) time constant of the quench thyristor in combination with the reactor 2. This time can be up to several seconds depending on the inductance of reactor 2. The trapping of energy in reactor 2 provides a further stabilizing effect on the leading edge of the current modulation envelope shape, assisting in the attainment of the nearly perfectly rectangular modulation envelop pattern. At the end of each modulation envelope the DC current passes through zero and the recovery energy from the diodes in rectifier 1 appears in the form of a high energy voltage transient which is conducted through diode 8 into capacitor 12 whereafter its energy is dissipated into resistor 18. Without this feature potentially damaging transient voltage levels would be impressed across rectifier 1 during the transition of current through zero.

Without the quench thyristor means and associated control means described above, the leading edge of the modulation envelope pattern will have a damped sinusoidal contour superimposed upon the rectangular pulse modulation envelope, which could be deleterious to the surface characteristics of the continuously cast end product.

The oscillatory process described repeats itself at the programmed firing frequency rate, which is typically a fixed frequency not greater than 80 percent of the natural resonant frequency of the series connected load circuit. The average power and current to the load circuit is controlled by means of varying this firing frequency over a range of approximately 10 to 1 with respect to its maximum value by means of voltage to frequency converter 13 in combination with power setpoint potentiometer 14 which provides a variable control voltage to the control signal input of voltage to frequency converter 13.

As an alternative to the on-off modulation with special fast rise time and rectangular envelope control means as previously described, the modulation of the output current of the converter according to any other periodic or arbitrary waveform can be accomplished by means of application a desired control signal from the output of modulating envelope signal generator 15 to the control input of controllable rectifier 1. Continuously variable amplitude modulation in accordance with sine, triangular, trapezoidal, 2 level pulse, and arbitrary patterns with a preset repetition rate or at a rate determined by the external trigger input from the mold longitudinal oscillation mechanism can then be obtained as required for optimization of the surface quality or metallographic microstructure of the continuously cast end product.

Typical operational waveforms associated load coil current during operation for the series resonant converter used in various embodiments of the continuous caster according to the present invention are shown in FIGS. 3 through 7.

Figure 3:
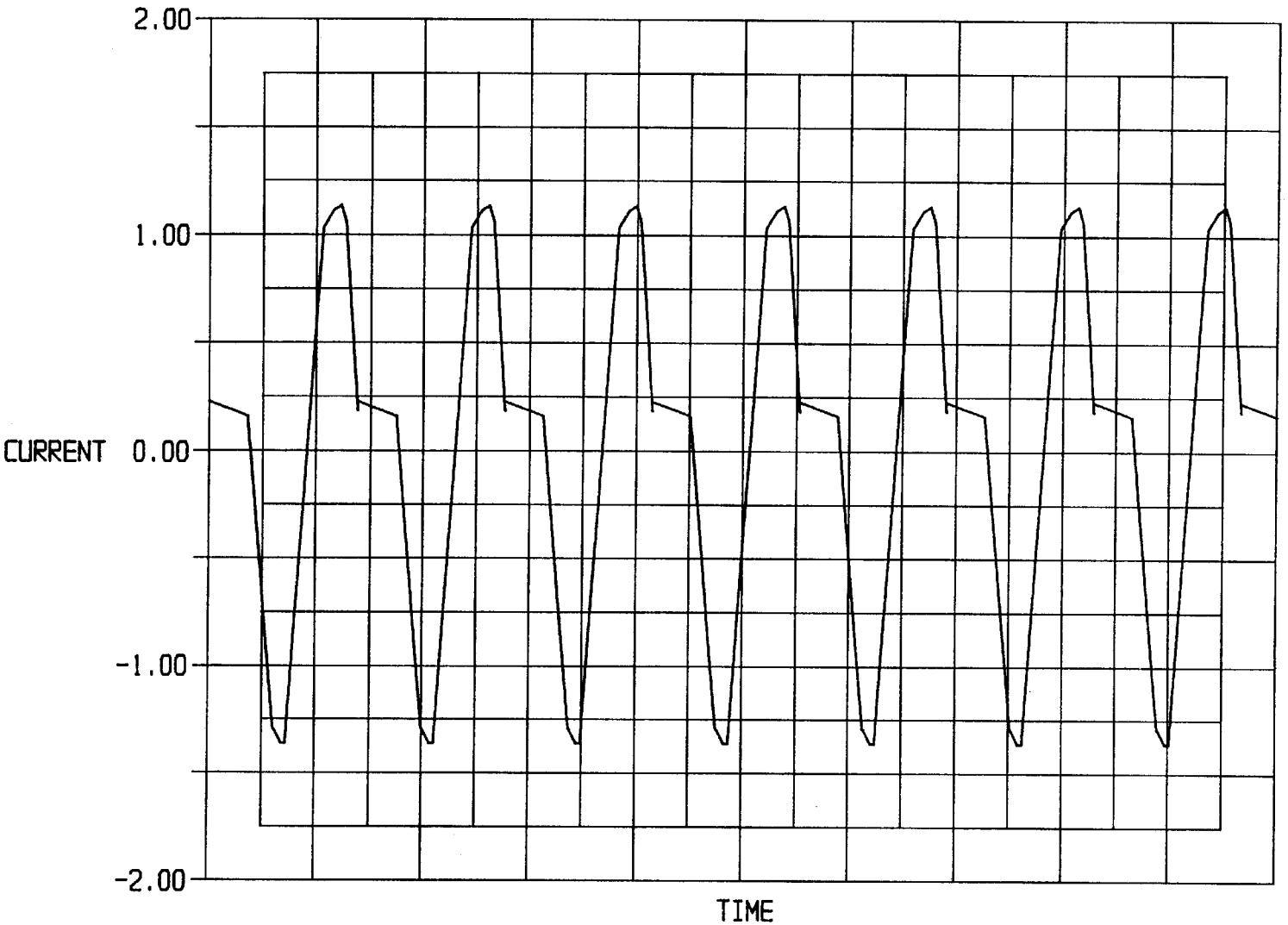
FIG. 3 is a representation of a typical resonant load coil current of the series resonant converter used in a device according to a preferred embodiment of the present invention.

FIG. 3 shows a typical representation of the resonant load coil current during operation in an embodiment employing a series resonant converter as described in the foregoing.

Figure 4:
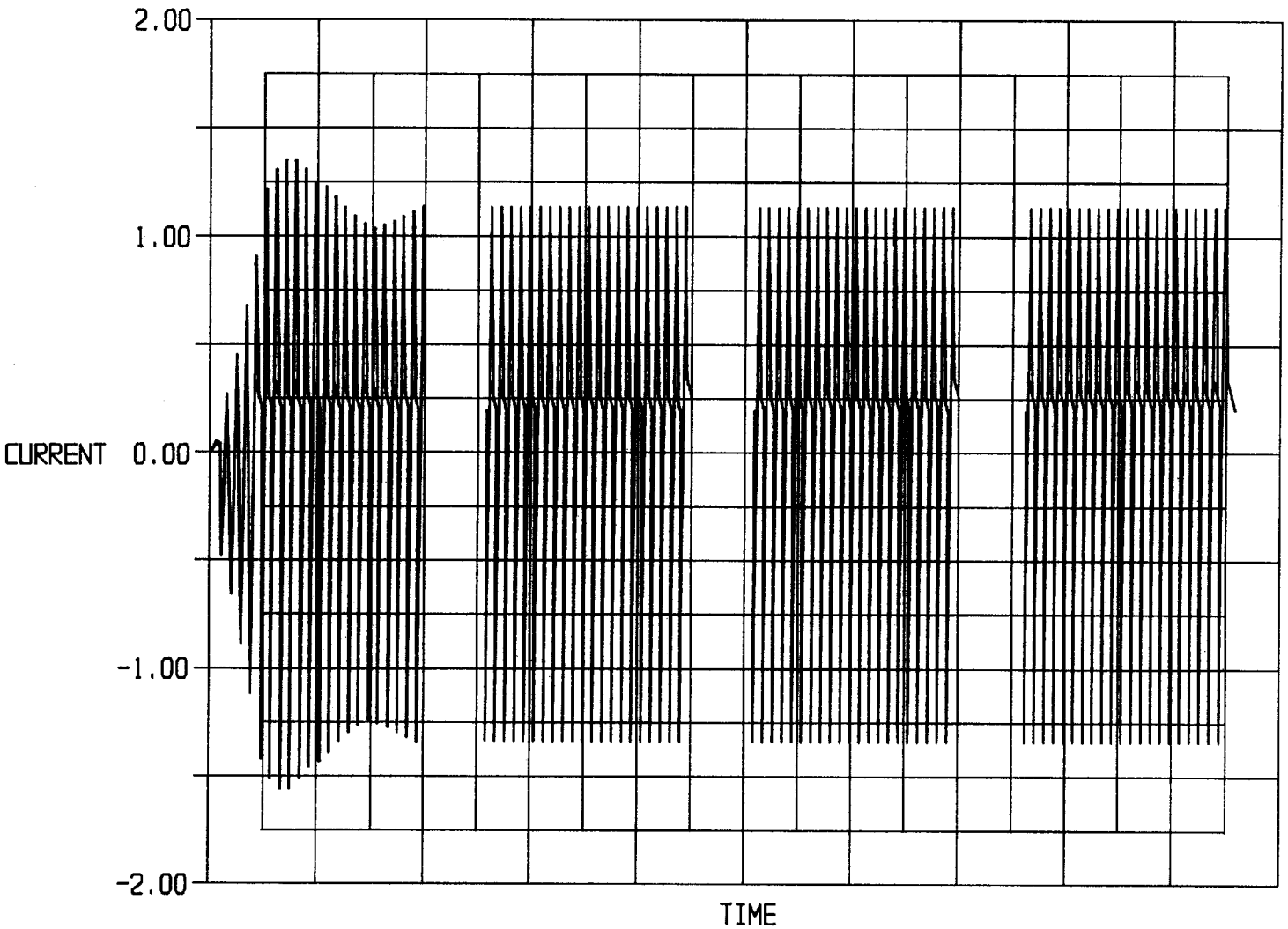
FIG. 4 is a representation of a typical load coil current during operation of a device according to a preferred embodiment of the present invention when in the special fast rise time, rectangular on-off modulation mode using the special quench thyristor.

FIG. 4 shows a typical load coil current during operation in an embodiment employing a series resonant converter characterized by the special fast rise time, rectangular on off modulation mode using the special quench thyristor.

Figure 5:
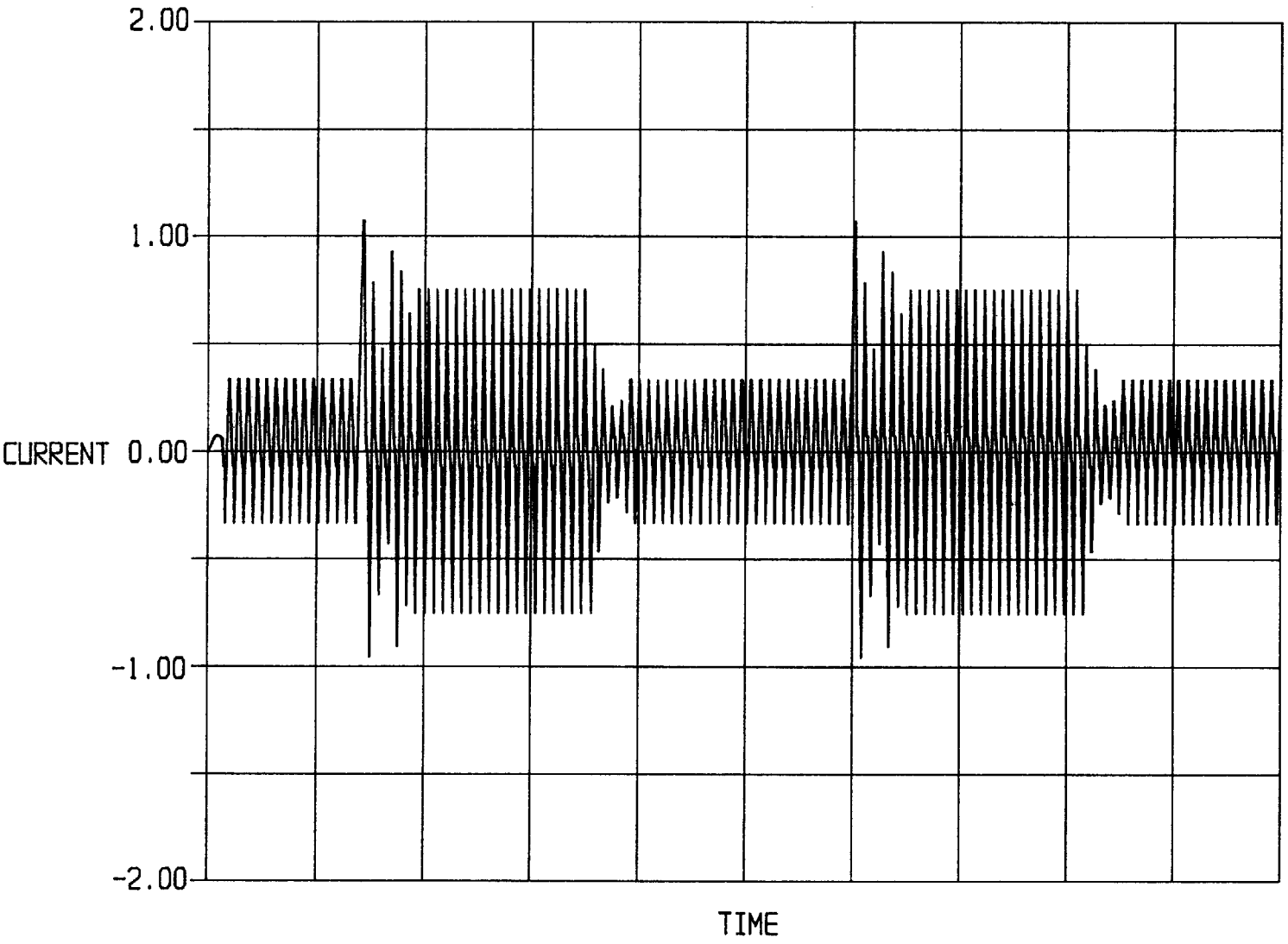
FIG. 5 shows the load coil current during operation of a device according to a preferred embodiment of the present invention when in the two level rectangular pulse modulation mode.

FIG. 5 shows a typical load coil during operation in an alternative embodiment employing a series resonant converter characterized by the two level rectangular pulse modulation mode.

Figure 6:
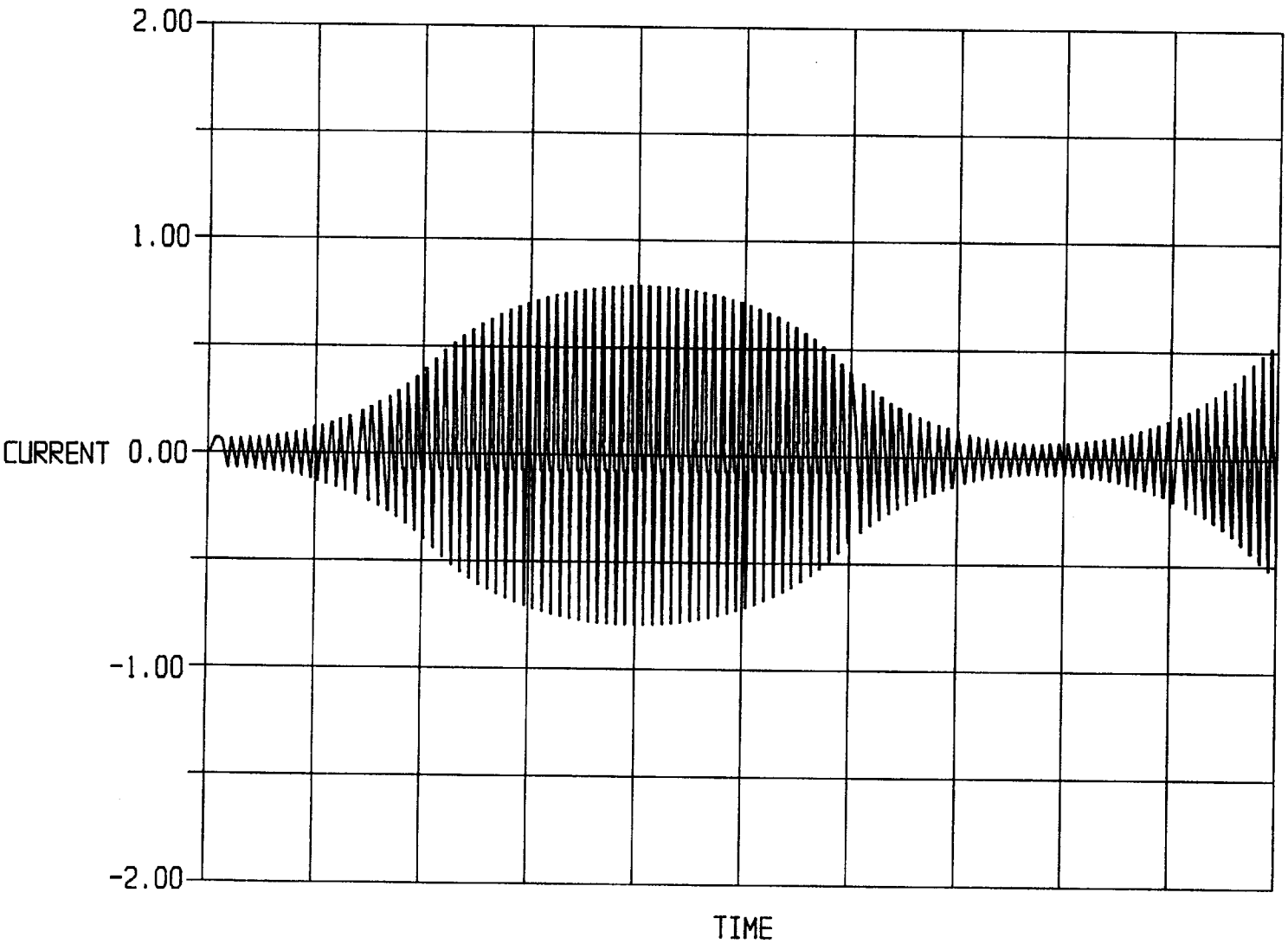
FIG. 6 is the load coil current during operation of a device according to a preferred embodiment of the present invention when in the sinusoidal modulation mode.

FIG. 6 shows a typical load coil current during operation in a further embodiment employing a series resonant converter characterized by the sinusoidal modulation mode.

Figure 7:
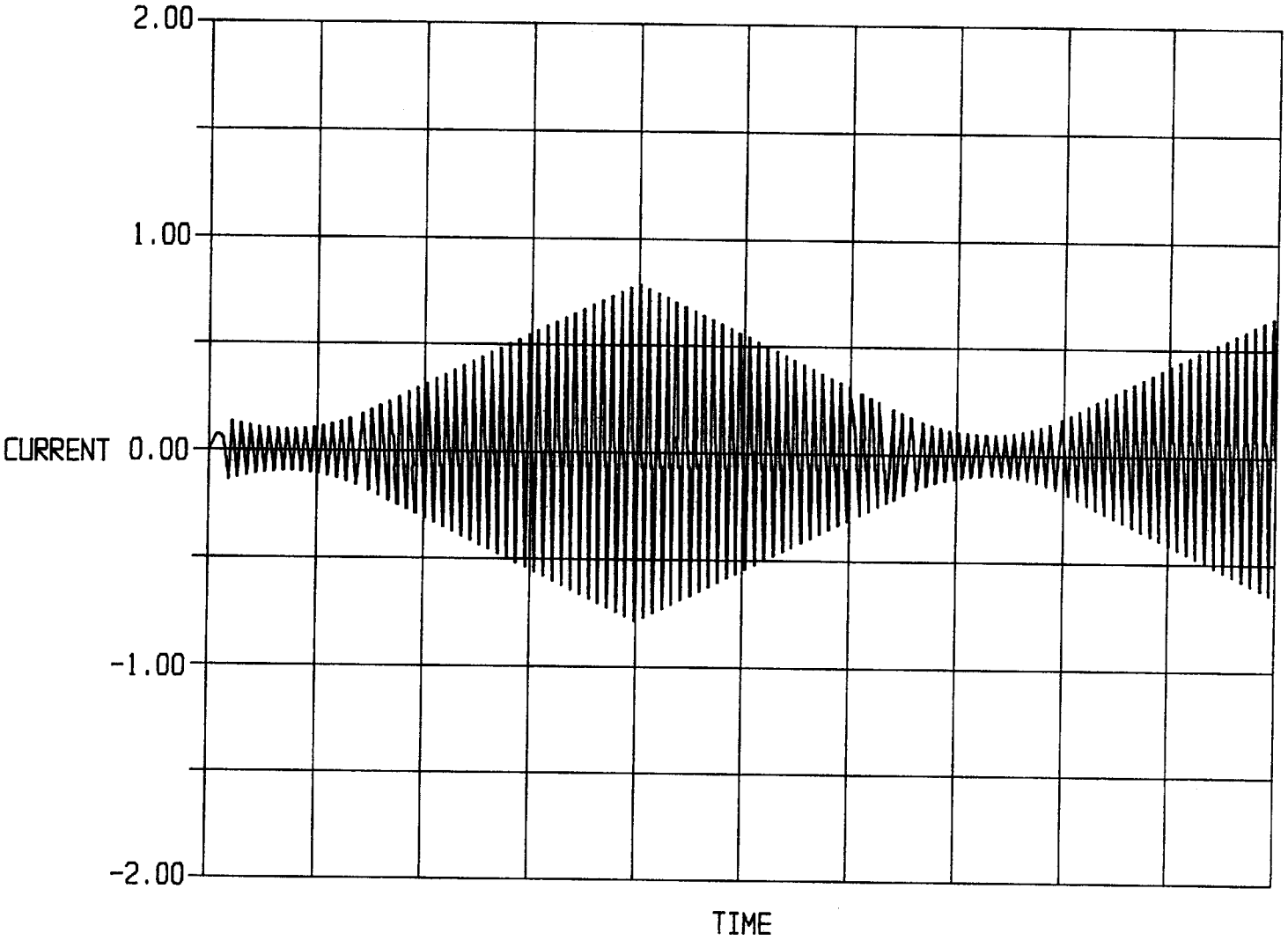
FIG. 7 is the load coil current during operation of a device according to a preferred embodiment of the present invention when in the triangular modulation mode.

FIG. 7 shows a typical load coil current during operation in still another embodiment employing a series resonant converter characterized by the triangular modulation mode.

What is claimed is:

1. A method for continuous or semi-continuous casting of metal, comprising the steps of:

supplying hot melt to a cooled continuous casting mold, cooling and forming the melt to an at least partly solidified strand, by passing the partly solidified melt through the mold, and applying a high frequency magnetic field having a base frequency of from 50 Hz or more to act on the melt at the top end of the mold using an inductive coil for developing heat and compressive forces in the melt acting to separate the melt from the mold wall, supplying a current from a power supply to the coil for generating the magnetic high frequency field, controlling the supplied current in a pulsed, amplitude modulated manner with an amplitude modulated modulation frequency of about 10 Hz or less, thereby achieving substantially full amplitude of the amplitude modulated current within a rise time corresponding to about 1 cycle of the base frequency or less at the start of a pulse.

2. A method for continuous casting according to claim 1, wherein the rise time corresponds to ¼ (0.25) cycle of the base frequency or less at the start of a pulse.

3. A method for continuous casting according to claim 1, wherein the current is pulsed with a modulation frequency of from 0.1 to 10 Hz.

4. A method according to claim 1, wherein the duty cycle of the high frequency current can be varied from 0 to 100% of the modulation frequency period.

5. A method for continuous casting according to claim 1, wherein the high frequency current is supplied with a base frequency of from 50 to 1000 Hz.

6. A method for continuous casting according to claim 5 wherein the high frequency current is supplied with a base frequency of about 200 Hz.

7. A method for continuous casting according to claim 1, wherein the pulsed current is supplied in an essentially rectangular manner where the amplitude is varied between two current levels.

8. A method for continuous casting according to claim 7, wherein the pulsed current is supplied in an essentially rectangular on-off manner wherein the output current in the off-periods is an essentially zero output current.

9. A method for continuous casting according to claim 7, wherein the pulsed current is supplied in an essentially rectangular manner, where the amplitude is varied between two amplitude current levels, wherein the output current at both levels is separated from zero.

10. A method for continuous casting according to claim 7, wherein the time-period for fall of the current amplitude at the end of a pulse is minimized to a time corresponding to 1 cycle of the base frequency of the high frequency current or less.

11. A method for continuous casting according to claim 10, wherein the time-period for fall of the current amplitude at the end of a pulse is minimized to a time corresponding to ¼ (0.25) cycle of the base frequency of the high frequency current or less.

12. A method for continuous casting according to claim 1, wherein the mold is oscillated and that the pulsed modulation frequency of the amplitude modulated current is associated with the frequency of the mold oscillation, such that the variations in the compressive forces are coordinated with the mold oscillation.

13. A method for continuous casting according to claim 12, wherein the current is pulsed with a modulation frequency in the same order as the oscillation frequency.

14. A device for carrying out a method for continuous or semi-continuous casting of metal comprising, a cooled continuous casting mold having a top end, means for supplying hot metal to the mold, means for receiving a cast strand formed in the mold therefrom, an inductive coil arranged at the top end of the mold to, when supplied with an alternating electric high frequency current, generate a high frequency magnetic field to act upon the melt in the mold, whereby heat is developed in the melt and compressive forces acting to separate the melt from the mold wall are generated, and a power supply unit with current control means to supply an alternating electric high frequency current having a base frequency of 50 Hz or more to the inductive coil, wherein the current control means comprises modulation means for modulation and control of the supplied current in a pulsed, amplitude modulated manner with a modulation frequency of 10 Hz or less, for achieving essentially full amplitude of the amplitude modulated current within a rise time at the start of a pulse corresponding to 1 cycle of the base frequency or less, said modulation means including a quenching thyristor in parallel with a DC smoothing reactor.

15. A device according to claim 14, wherein the current control means comprises modulation means adapted for on-off modulation of the load coil current supplied to the coil.

16. A device according to claim 14, wherein the current control means comprises modulation means adapted for modulation between any two current levels of the load coil current supplied to the coil.

17. A device according to claim 14, wherein the current control means comprises modulation means adapted for modulation waveform envelope shapes having any periodic waveform pattern such as sine, triangular, or trapezoidal modulation envelopes of the load coil current supplied to the coil.

18. A device according to claim 14, wherein the current control means comprises modulation means adapted for a programmable arbitrary modulation waveform pattern generation of the load coil current supplied to the coil.

19. A device according to claim 18, wherein the current control means comprises a converter with a series resonant circuit with modulation means for supplying a current with an amplitude modulation pattern exhibiting an essentially rectangular wave configuration.

20. A device according to claim 19, wherein modulation means are arranged for supplying a current with an amplitude modulation pattern exhibiting an essentially rectangular wave configuration with off periods alternating with on periods in a supply frequency, wherein the off and on periods comprise a plurality of cycles of the base frequency of the amplitude modulated current supplied to the inductive coil.

21. A device according to claim 20, wherein the series resonant circuit comprises a quench thyristor in parallel with a DC smoothing reactor, and wherein the thyristor, in the on-off rectangular modulation mode is adapted to;

control the voltage to which the series resonant capacitor is charged at the end of each on modulation period to an optimal level, and trap the energy stored in the smoothing reactor during the off period with in each modulation cycle, thereby a release enabling of the energy into an inverter circuit at the beginning of the next on modulation period.

22. A device according to claim 18, wherein modulation means are arranged for supplying a current with a modulation pattern exhibiting an essentially rectangular wave configuration varying between two levels, that the current amplitude is held essentially constant at these two levels for time periods comprising a plurality of complete cycles of the base frequency of the amplitude modulated current supplied to the inductive coil.

* * * * *